United States Patent [19]

Ikeda

[11] Patent Number: 4,522,311

[45] Date of Patent: Jun. 11, 1985

[54] LID WITH A SEE-THROUGH PLATE

[75] Inventor: Yoshio Ikeda, Aichi, Japan

[73] Assignee: Tokyo Shibaura Denki Kabushiki Kaisha, Japan

[21] Appl. No.: 456,849

[22] Filed: Jan. 10, 1983

[30] Foreign Application Priority Data

Feb. 8, 1982 [JP] Japan ..... 57-19405

[51] Int. Cl.[3] ..... B65D 51/18

[52] U.S. Cl. ..... 220/254; 220/334; 220/82 R; 220/82 A

[58] Field of Search ..... 220/254, 82 A, 82 R, 220/334

[56] References Cited

U.S. PATENT DOCUMENTS

| | | | |
|---|---|---|---|
| 2,376,449 | 5/1945 | Oliver | 220/82 R |
| 2,495,552 | 1/1950 | Schmitz | 220/82 R |
| 2,609,655 | 9/1952 | Vermot | 220/82 R |
| 3,331,528 | 7/1967 | Racek | 220/82 R |
| 4,092,866 | 6/1978 | Miele, Jr. et al. | 220/82 A |
| 4,146,258 | 3/1979 | Andruchin | 220/82 R |

*Primary Examiner*—Joseph Man-Fu Moy

*Attorney, Agent, or Firm*—Cushman, Darby & Cushman

[57] ABSTRACT

A lid with a see-through plate to open and close an opening portion of an apparatus has a lid body which has an opening for visually checking the interior of the apparatus, a ring-shaped engaging groove formed along the periphery of the opening, and projections provided in the engaging groove. A see-through plate is removably attached to the lid body to close the opening. The see-through plate has an outer peripheral edge closely resembling the opening in shape and hooks engaging with the projections. The interior of the apparatus can be externally observed through the see-through plate. A decorative frame is removably fitted in the engaging groove to hold the see-through plate as the projections and hooks engage one another, and to cover the projections and hooks.

12 Claims, 8 Drawing Figures

LID WITH A SEE-THROUGH PLATE

BACKGROUND OF THE INVENTION

This invention relates to a lid to open and close an opening portion of an apparatus, more specifically to a see-through lid which comprises a lid body having an opening formed in the lid body, and a see-through plate covering the opening so that the interior of an apparatus may be observed through the see-through plate.

Conventionally, in a see-through lid of this type, a see-through plate is fixed to the peripheral edge of an opening in a lid body by adhesive bonding or ultrasonic welding or by a combination of these two methods. With the adhesive bonding method, however, the materials of the lid body and the see-through plate are limited to those materials which can be bonded with adhesives. Therefore, this method is not compatible with the use of, for example, polypropylene. Moreover, application of adhesives and joining of members are hard tasks. Also with the ultrasonic welding method, there are restrictions on the materials of the lid body and the see-through plate. In addition, this method requires special work and equipment which increases cost. If the see-through plate is fixed by the adhesive bonding or ultrasonic welding method, furthermore, the adhesion strength cannot easily be identified, so that there is a fear of defective products being produced. If the see-through plate firmly fixed to the lid body is broken or flawed, it is necessary to replace the lid body, not to mention the see-through plate. Moreover, the bonded or welded surfaces may sometimes be visible through the see-through plate spoiling the appearance of the lid.

SUMMARY OF THE INVENTION

This invention is contrived in consideration of these circumstances, and is intended to provide a lid with a see-through plate in which the see-through plate can readily be attached to a lid body without using adhesive bonding or welding and without spoiling the appearance of the lid, and which can be replaced independently, and in which the fitting condition of the see-through plate can be checked with ease.

According to one aspect of the invention, there is provided a see-through lid which comprises a lid body having an opening for visually checking the interior of an apparatus, a ring-shaped engaging groove formed along the periphery of the opening, and first engaging means provided in the engaging groove, the lid body opening and closing the opening portion of the apparatus, a see-through plate having an outer peripheral edge closely resembling the opening in shape and second engaging means engaging the first engaging means, and removably attached to the lid body to close the opening, so that the interior of the apparatus can be externally observed through the see-through plate, and holding means removably fitted in the engaging groove to hold the see-through plate as the first and second engaging means are engaged, and to cover the first and second engaging means.

According to the lid of the invention, the see-through plate is attached to the lid body by causing the second engaging means to engage the first engaging means without using the adhesive bonding or welding. Accordingly, the fitting condition of the see-through plate can be checked with ease, and the see-through plate can be replaced independently. Moreover, the see-through plate cannot easily be removed from the lid body, since it is held by the holding means so that the second engaging means are caused to engage the first engaging means so as to cover or close the opening. Covered with the holding means, the first and second engaging means do not spoil the appearance of the see-through lid.

BRIEF DESCRIPTION OF THE DRAWINGS

FIGS. 2 to 7 show the see-through lid according to the one embodiment of the invention, in which FIG. 2 is a disassembled perspective view, FIG. 3 is a disassembled sectional view, FIG. 4 is a plan view, FIG. 5 is a sectional view taken along line V—V of FIG. 4, FIG. 6 is a sectional view taken along line VI—VI of FIG. 4, and FIG. 7 is a sectional view taken along line VII—VII of FIG. 4.

DETAILED DESCRIPTION OF THE PREFERRED EMBODIMENT

There will now be described in detail an embodiment of this invention with reference to the accompanying drawings.

Figure 1:
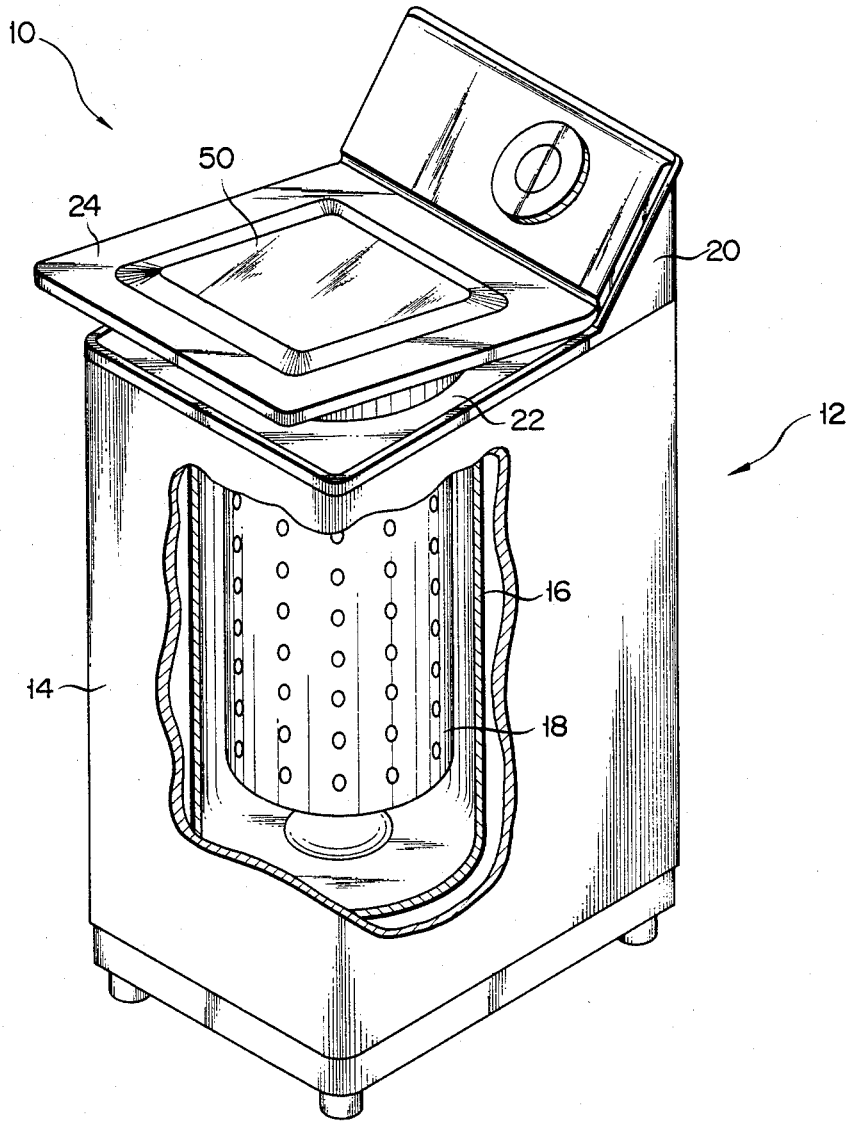
FIG. 1 is a perspective view of a dehydrator having a lid with a see-through plate according to one embodiment of this invention.

FIG. 1 shows a dehydrator 12 having a lid 10 with a see-through plate according to the embodiment of the invention. The dehydrator 12 includes a casing 14, a water reservoir 16 inside the casing, a dehydrating tank 18 rotatable in the water reservoir, and a control box 20 mounted on the top of the casing. The lid 10 is used to open and close an opening portion 22 of the casing 14 through which washing is put into or taken out of the dehydrating tank 18.

Figure 2:
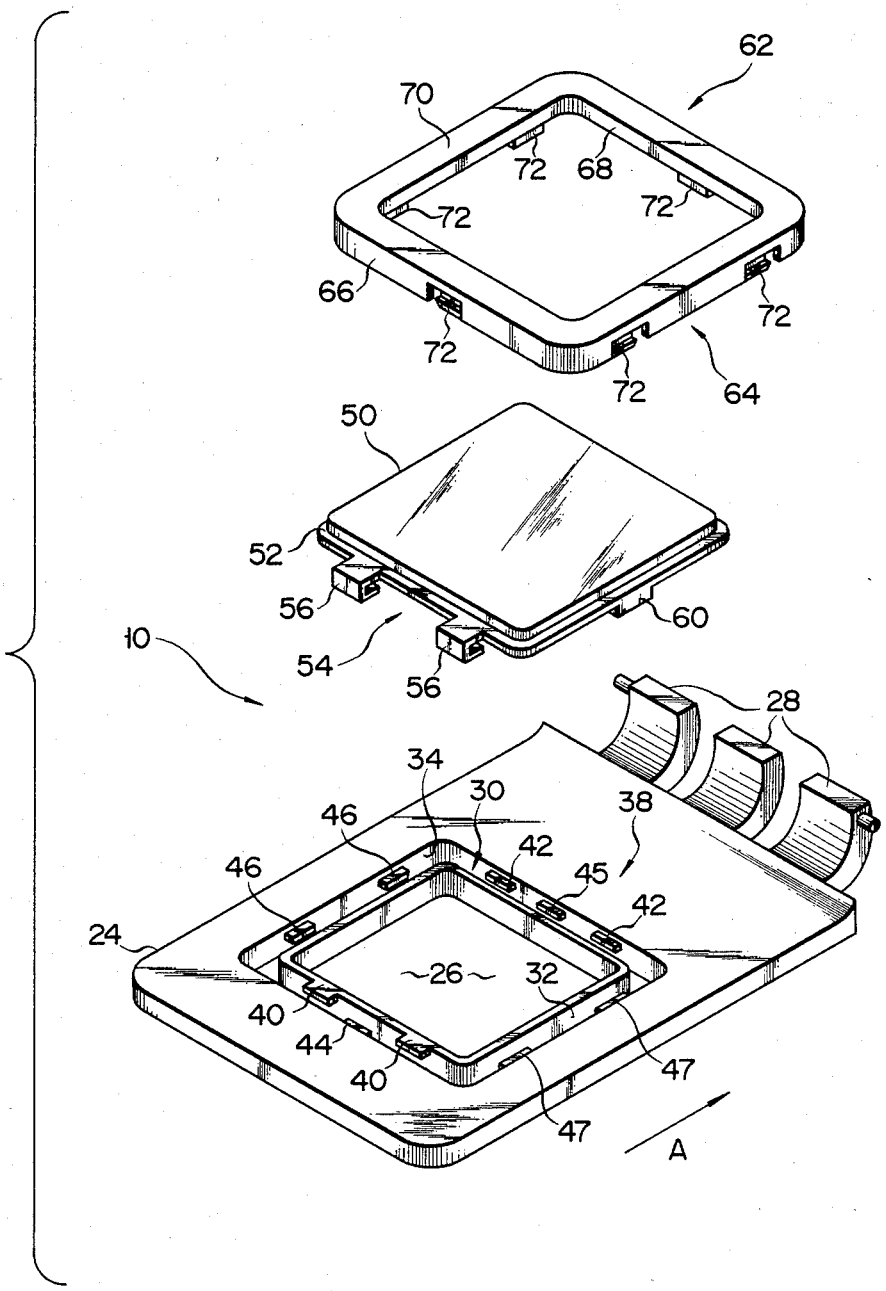

As shown in FIGS. 1 and 2, the see-through lid 10 has a lid body 24 in the form of a plate elongated in the direction indicated by arrow A. The lid body 24 has a rectangular opening 26 in the substantially central portion thereof for visually checking the interior of the dehydrating tank 18. The lid body 24 also has a hinge 28 extending from its rear end edge. The lid body 24 is rockably supported on the control box 20 by the hinge 28 to open and close the opening portion 22 of the casing 14. As seen from FIGS. 2 to 7, the lid body 24 has a ring-shaped engaging groove 30 along the periphery of the opening 26. The engaging groove 30 has an inner peripheral surface 32 along the peripheral edge of the opening 26, an outer peripheral surface 34 facing the inner peripheral surface at a predetermined space therefrom, and a bottom surface 36. The lid body 24 also has first engaging means 38 in the engaging groove 30. The first engaging means 38 includes a pair of first projections 40 and a pair of second projections 42. The first projections 40 extend into the engaging groove 30 from the inner peripheral surface 32 thereof on one side or the left-hand side (in FIG. 4) of the opening 26, and are spaced from each other. The second projections 42 extend into the engaging groove 30 from the outer peripheral surface 34 thereof on the other side or the right-hand side (in FIG. 4) of the opening 26, and are spaced from each other. The lid body 24 further has a plurality of additional projections 44, 45, 46 and 47 extending into the engaging groove 30 from the outer peripheral surface 34 thereof. The projection 44 protrudes from the outer peripheral surface 34 on the left-hand side of the opening 26 in FIG. 4, and is located between the two first projections 40. The projection 45 protrudes from the outer peripheral surface 34 on the right-hand side of the opening 26, and is located between the two second projections 42. The pair of projections 46 extend from the outer peripheral surface 34 on the upper side of the opening 26, in FIG. 4 and are spaced from each other. The pair of projections 47 extend from the outer peripheral surface 34 on the lower side of the opening 26, in FIG. 4 and are spaced from each other. The lid body 24 also has a plurality of holes 48 bored through the bottom surface 36 of the engaging groove 30. The holes 48 individually face the projections 40, 42, 44, 45, 46 and 47. The lid body 24 is integrally formed from resin, and the holes 48 are formed by a die for making the projections 40, 42, 44, 46 and 47.

The see-through lid 10 includes a see-through plate 50 which is removably attached to the lid body 24 to cover the opening 26. The see-through plate 50 is formed from a transparent material into a rectangular member substantially equal to the opening 26 in size. The see-through plate 50 has a flange 52 extending outward from its peripheral edge. The see-through plate 50 also has second engaging means 54 capable of engaging the first engaging means 38 of the lid body 24. The second engaging means 54 includes a pair of first hooks 56 extending from one side or the left-hand side (in FIG. 4) of the flange 52 and capable of individually engaging the first projections 40. As seen from FIG. 3, each first hook 56 has a substantially U-shaped section. The second engaging means 54 further includes a pair of second hooks 58 extending from the right-hand side of the flange 52 and capable of individually engaging the second projections 42. As seen from FIG. 3, each second hook 58 has an L-shaped section. The see-through plate 50 has a pair of guide projections 60 individually extending from the upper and lower sides of the flange 52 in FIG. 4. The guide pawls 60 are so formed that they can engage those portions of the inner peripheral surface 32 of the engaging groove 30 which are located on the upper and lower sides of the opening 26 in FIG. 4.

Figure 3:
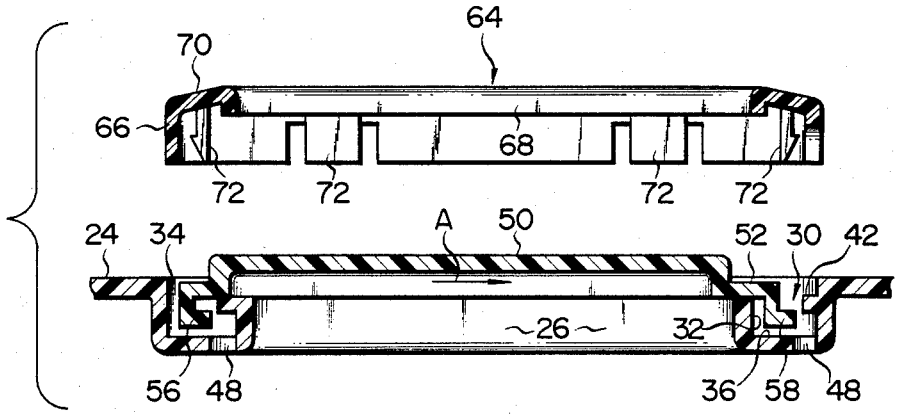
Figure 4:
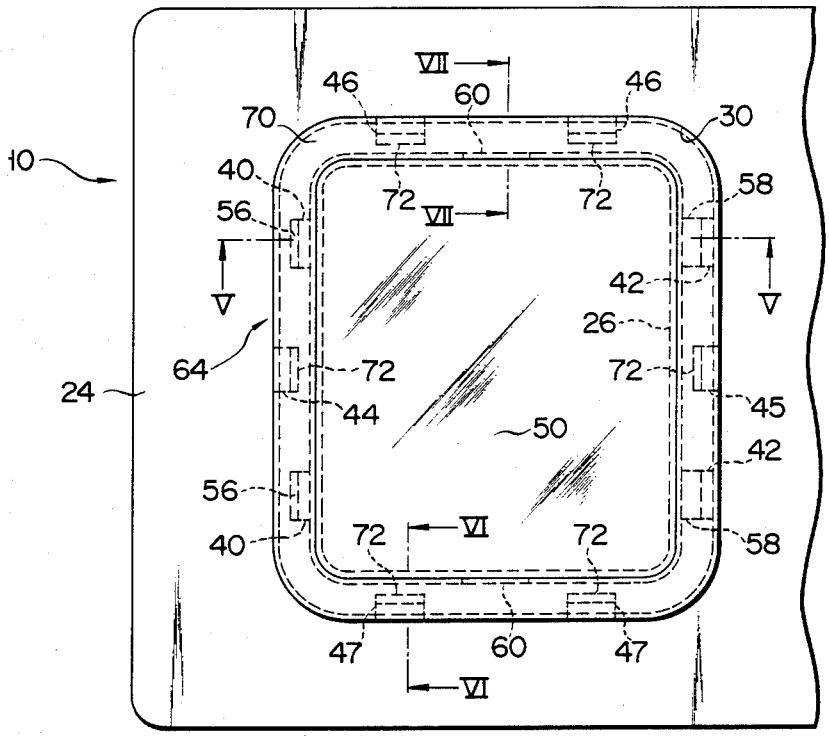
Figure 5:
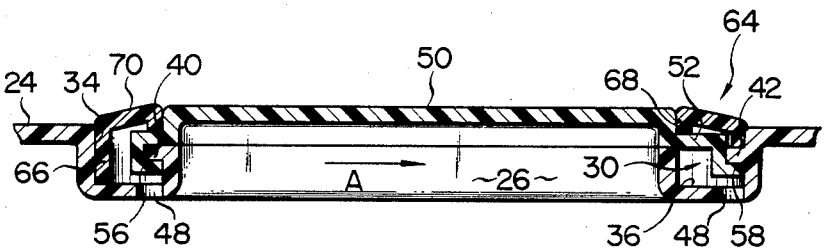
Figure 6:
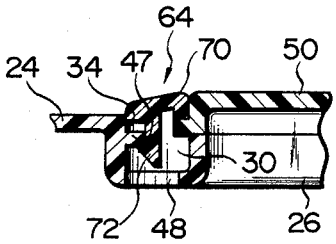
Figure 7:
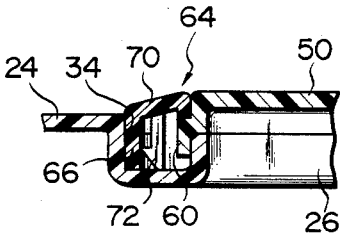

As shown in FIG. 3, the see-through plate 50 is laid over the opening 26 so that the first and second hooks 56 and 58 are located in the engaging groove 30, and that the guide pawls 60 are in contact with the inner peripheral surface 32 of the engaging groove 30. Thereafter, the see-through plate 50 is moved in the extending direction of the lid body 24, that is, in the direction of arrow A. As a result, the first and second hooks 56 and 58 are caused to engage the first and second projections 40 and 42, respectively, as shown in FIG. 5. The see-through plate 50 is guided by the guide pawls 60 in its movement in the direction of arrow A. Thus, the see-through plate 50 is removably attached to the lid body 24 to cover the opening 26.

The see-through lid 10 is further provided with holding means 62 which is removably fitted in the engaging groove 30 to cover and keep the first and second engaging means 38 and 54 in engagement with each other. The holding means 62 includes a ring-shaped decorative frame 64 removably fitted in the engaging groove 30. The decorative frame 64 has an outer peripheral wall 66 capable of engaging the outer peripheral surface of the engaging groove 30, an inner peripheral wall 68 capable of engaging the outer peripheral edge of the see-through plate 50, and a top wall 70 closely resembling the engaging groove 30 in shape. Also, the decorative frame 64 has a plurality of elastic pawls 72 capable of engaging the projections 44, 45, 46 and 47 of the lid body 24. As seen from FIGS. 3 and 4, the elastic pawls 72 extend downward from the top wall 70, and are located in those individual positions which correspond to the projections 44, 45, 46 and 47. Those portions of the outer peripheral wall 66 which face the elastic pawls 72 are cut. As seen from FIGS. 4 to 7, the decorative frame 64 is fitted in the engaging groove 30 so that its outer and inner peripheral walls 60 and 62 are in contact with the outer peripheral surface 34 of the engaging groove 30 and the outer peripheral edge of the see-through plate 50, respectively. The elastic pawls 72 individually engage the projections 44, 45, 46 and 47 of the lid body 24, thereby preventing the decorative frame 64 from slipping out of the engaging groove 30. The projections 44, 45, 46 and 47 and the elastic pawls 72 constitute retaining means in this invention. Thus, the decorative frame 64 prevents the see-through plate 50 from moving in the opposite direction to the direction of arrow A, retaining the see-through plate 50 as the first and second engaging means 38 and 52 are engaged with each other. The top wall 70 of the decorative frame 64 blocks the engaging groove 30, covering the first and second engaging means 38 and 54 and the projections 44, 45, 46 and 47.

In detaching the see-through plate 50, the decorative frame 64 is first removed from the engaging groove 30. The decorative frame 64 is removed by pushing the elastic pawls 72 to disengage them from the projections 44, 45, 46 and 47 by means of, for example, a screwdriver. The screwdriver is inserted in the engaging groove 30 through the hole 48. Thereafter, the see-through plate 50 is moved in the opposite direction to the direction of arrow A so that the first engaging means 38 is disengaged from the second engaging means 54. Thus, the see-through plate 50 is detached from the lid body 24.

Constructed in this manner, the see-through lid 10 has the following function and effect. The see-through plate 50 is attached to the lid body 24 by moving it straight to cause the first and second engaging means 38 and 54 to engage each other and fitting the decorative frame 64 in the engaging groove 30. Thus, the see-through plate can be attached to the lid body without using adhesive bonding or ultrasonic welding, and the lid can be easily assembled without using any special equipment. The see-through plate may be formed from any suitable material, even a low-priced material. Therefore, the see-through lid can be manufactured at low cost. The fitting condition of the see-through plate 50 can be checked easily by only examining the engagement between the elastic pawls 72 and the projections 44, 45, 46 and 47. If the see-through plate 50 is damaged, it can readily be removed by only disengaging the elastic pawls 72 and the first engaging means 38 from the projections 44, 45, 46 and 47 and the second engaging means 54, respectively. Thus, the lid body 24 requires no replacement and ensures good economical efficiency. The first and second engaging means 38 and 54 and the projections 44, 45, 46 and 47 are covered with the decorative frame 64. Accordingly, the engaging portions are prevented from being visually exposed to the outside directly or through the see-through plate 50. The appearance of the lid may be improved by decorating the top wall 70 of the decorative frame 70 with, for example, a pattern.

Figure 8:
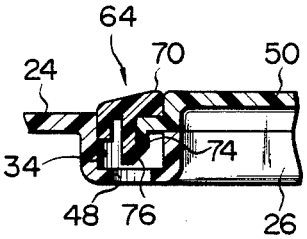
FIG. 8 is a sectional view showing a modification.

It is to be understood that this invention is not limited to the embodiment described above, and that various changes and modifications may be effected therein by one skilled in the art without departing from the scope or spirit of the invention. As shown in FIG. 8, for example, the retaining means may include projections 74 on the outer peripheral edge of the see-through plate 50 and elastic pawls 76 extending from the top wall 70 of the decorative frame 64 and engaging the projections 74. Instead of using the elastic pawls and the projections for the retaining means, the outer peripheral surface 34 of the engaging groove 30 and the outer peripheral wall 66 of the decorative frame 64 may be roughed for increased friction. Moreover, the second projection 42 may be replaced with a hole in the outer peripheral wall of the engaging groove 30 to engage the second hook 52. The opening 26 is not limited to the rectangular shape, and may be polygonal, elliptic or circular. The see-through lid of this invention may be applied to suitable machines and apparatus other than the dehydrator, e.g., washing machines, drying machines, etc.

What is claimed is:

1. A lid to close an access port of an apparatus comprising:

a lid body defining an opening to permit visual inspection of the interior of the apparatus, said lid body including (a) a recessed engaging groove defined around the periphery of said opening, (b) first engaging means disposed in said engaging groove, and (c) hinge means for connection to said apparatus to permit said lid body to pivotally move between open and closed positions to respectively open and close the access port;

a removable transparent member sized and configured to cover said opening and including second engaging means for engaging said first engaging means to thereby couple said transparent member to said lid body in response to said transparent member being moved into an engaged position and for disengaging said first engaging means to thereby permit removal of said transparent member in response to said transparent member being moved to a disengaged position; and holding means defining an aperture and removably mounted to said lid body so that said aperture is in registry with said transparent member and so that said holding means covers said engaging groove for holding said transparent member in said engaged position; wherein said lid body further includes plural retaining members disposed in said engaging groove each defining a flange; and wherein said holding means includes plural elastic pawl means each defining an engaging surface, each said pawl means elastically engaging a respective flange of said retaining members to removably hold said transparent member in said engaged position with said lid body whereby upon removal of said holding means, movement of said transparent member to said disengaged position is permitted to thereby allow removal of said transparent member from said lid body.

2. The lid according to claim 1, wherein said second engaging means includes first and second hooks to engage the first engaging means as the transparent member is moved into said engaged position.

3. The lid according to claim 2, wherein said engaging groove has an inner peripheral surface along the peripheral edge of the opening, an outer peripheral surface facing the inner peripheral surface at a predetermined space therefrom, and a bottom surface.

4. The lid according to claim 3 wherein said first engaging means includes a first projection extending into the engaging groove from that portion of the inner peripheral surface of the engaging groove which is located on a second side of the opening which is normal to said one side and engaging the first hook, and a second projection extending into the engaging groove from that portion of the outer peripheral surface of the engaging groove which is located on a third side of the opening opposite to the second side.

5. The lid according to claim 3, wherein said first hook extends outward from one side of the outer peripheral edge of the transparent member, and the second hook extends outward from another side of the outer peripheral edge opposite to the one side thereof.

6. The lid according to claim 5, wherein said transparent member includes a pair of guide pawls for guiding the transparent member into said engaged and disengaged positions, the guide pawls extending individually from the remaining two sides of the outer peripheral edge of the transparent member to engage the inner peripheral surface of the engaging groove.

7. The lid according to claim 3, wherein said holding means includes a ring-shaped decorative frame restraining the transparent member from moving into said disengaged position and covering the first and second engaging means, the decorative frame having an outer peripheral wall engaging the outer peripheral surface of the engaging groove, an inner peripheral wall engaging the outer peripheral edge of the transparent member, and a top wall having a shape substantially equal to that of the engaging groove and covering the engaging groove.

8. The lid according to claim 7, which further comprises retaining means for removably retaining said holding means in the engaging groove to prevent the holding means from slipping out of the engaging groove.

9. The lid according to claim 8, wherein said retaining means includes a plurality of projections extending from the outer peripheral surface of the engaging groove into the engaging groove and a plurality of elastic pawls extending from the decorative frame and individually engaging the projections.

10. The lid according to claim 9, wherein said lid body has a plurality of holes for disengaging the projections from the elastic pawls, which are bored through the bottom surface of the engaging groove to face the individual projections.

11. The lid according to claim 8, wherein said retaining means includes a plurality of projections extending from the outer peripheral edge of the see-through plate into the engaging groove and a plurality of elastic pawls extending from the decorative frame and individually engaging the projections.

12. The lid according to claim 11, wherein said lid body has a plurality of holes for disengaging the projections from the elastic pawls, which are bored through the bottom surface of the engaging groove to face the individual projections.

* * * * *